252-95 AU 166 EX

7/14/81 XR 4,278,571

United States Patent [19]

Choy

[11] 4,278,571

[45] Jul. 14, 1981

[54] SURFACTANT CAKE COMPOSITIONS

[75] Inventor: Clement K. Choy, Danville, Calif.

[73] Assignee: The Procter & Gamble Company, Cincinnati, Ohio

[21] Appl. No.: 154,000

[22] Filed: May 28, 1980

[51] Int. Cl.[3] ..... C11D 1/22; C11D 3/04; C11D 17/00; E03D 9/02

[52] U.S. Cl. ..... 252/558; 252/89.1; 252/95; 252/106; 252/174; 252/174.24; 252/539; 252/DIG. 16; 239/34; 424/14

[58] Field of Search ..... 252/89.1, 106, 134, 252/174, 539, 558, DIG. 16; 424/14; 239/34

[56] References Cited

U.S. PATENT DOCUMENTS

| | | | |
|---|---|---|---|
| 1,750,198 | 3/1930 | Schrauth | 252/558 |
| 2,184,171 | 12/1939 | Sponsel | 252/558 |
| 2,781,320 | 2/1957 | Jelinek | 252/121 |
| 2,781,321 | 2/1957 | Mayhew | 252/558 |
| 3,178,370 | 4/1965 | Okenfuss | 252/529 |
| 3,216,932 | 11/1965 | Heiss | 210/32 |
| 3,425,948 | 2/1969 | Otrhalek | 252/558 |
| 3,461,074 | 8/1969 | Schwalley | 252/539 |
| 3,578,499 | 5/1971 | Crotty | 134/4 |
| 3,748,093 | 7/1973 | Gangwisch | 8/137 |
| 3,755,201 | 8/1973 | Trimmer | 252/526 |

FOREIGN PATENT DOCUMENTS 53-124182 10/1978 Japan .

OTHER PUBLICATIONS

Bulletin 206-E, Published by Petrochemicals Inc., Fort Worth, Texas.

*Primary Examiner*—Dennis L. Albrecht
*Attorney, Agent, or Firm*—Ronald L. Hemingway; Richard C. Witte

[57] ABSTRACT

Solid cake compositions comprising from about 20% to 50% of a naphthalene sulfonate surfactant and from about 30% to 80% of a water-soluble salt, the ratio of said surfactant to said salt being from about 1:0.3 to 1:4.

4 Claims, No Drawings

SURFACTANT CAKE COMPOSITIONS

TECHNICAL FIELD

The present invention relates in general to a solid cake surfactant composition which is particularly useful in conjunction with a toilet tank dispenser to automatically dispense a ration of surfactant and, optionally, other ingredients to the bowl of a toilet, responsive to the flushing of the toilet.

BACKGROUND ART

In treating toilet flush water with chemicals in order to produce desirable effects such as bowl cleaning, disinfection, deodorization, aerosol reduction, etc., it is desirable that the chemicals be dispensed into the flush water automatically each time the toilet is flushed. The prior art discloses numerous devices which have been designed for this purpose. Exemplary of such devices are those disclosed in U.S. Pat. No. 3,831,205, issued Aug. 27, 1974 to Foley, U.S. Pat. No. 3,341,074 issued Sept. 12, 1967 to Pannutti, U.S. Pat. No. 3,504,384 issued Apr. 7, 1970 to Radley et al., U.S. Pat. No. 2,688,754 issued Sept. 14, 1954 to Willets et al. and U.S. Pat. No. 4,036,407, issued July 19, 1977 to Slone. Particularly desirable devices are those wherein the chemical composition is in the device in the form of a solid cake composition. In this type of device a measured amount of water enters the device during one flush cycle and remains in contact with the cake composition between flushes, thereby forming a concentrated solution of the composition which is dispensed into the flush water during the next flush. Obvious advantages of such devices are that the chemical composition can be packaged and shipped in more concentrated form than aqueous solutions of the chemicals, and the problems of liquid spillage resulting from breakage of the dispensers during shipment or handling is eliminated. Especially preferred devices for automatic dispensing of chemicals from solid cake compositions into the toilet are those described in U.S. Pat. No. 4,171,546 of Dirksing, issued Oct. 23, 1979, U.S. Pat. No. 4,208,747, Dirksing, issued June 24, 1980, U.S. Pat. No. 4,186,856, Dirksing, issued Feb. 5, 1980, and Application U.S. Ser. No. 58,974 of Williams and Owens filed July 20, 1979, all of said applications being incorporated herein by reference.

A particularly desirable component of cake compositions used in the aforedescribed dispensing devices is a surfactant (see Application U.S. Ser. No. 915,027, Kitko, filed June 12, 1978, U.S. Pat. No. 4,200,606, Kitko, issued Apr. 28, 1980 and Application U.S. Ser. No. 153,993, Choy and Greene, entitled "POLY-(ETHYLENE OXIDE) COMPOSITIONS WITH CONTROLLED SOLUBILITY CHARACTERISTICS", filed May 28, 1980, all incorporated by reference herein). The surfactants provide cleaning and sudsing in the toilet bowl and also serve to disperse other components of the compositions such as dyes, perfumes, organic resins, etc. in the flush water. Anionic surfactants, especially the organic sulfate and sulfonate types, are particularly desirable for use in these compositions because of their availability, low cost and excellent cleaning and dispersing properties. Water soluble inert salts such as alkali metal chlorides and sulfates are desirably used in such compositions to act as a "filler" or "bulking agent" so that the composition can be formed into cakes or reasonable size without using excessive and wasteful amounts of active ingredients. The predominant ingredients in the cake compositions are usually the surfactant and the filler salt. In concentrated aqueous systems (such as formed within an automatic toilet treating dispenser during the period between flushes), salts often tend to "salt out" anionic surfactants, thereby rendering them insoluble and incapable of performing their intended function. In formulating anionic surfactant-containing cakes for use in automatic toilet dispensing devices it has been found that, in order to avoid a "salting out" effect on the surfactant which would prevent the attainment of the desired concentration of surfactant in solution in the dispenser, it was necessary to use a ratio of surfactant to salt which required the use of much more surfactant than would otherwise be necessary for the surfactant to perform its cleaning and dispersing function if salt were not present. This is wasteful of surfactant.

The object of the present invention is to provide detergent cake formulations which comprise anionic surfactant and salt wherein relatively high levels of salt can be used without reducing the solubility of the surfactant to an unacceptable degree.

SUMMARY OF THE INVENTION

The present invention is directed to solid cake compositions which comprise from about 20% to about 50% of a naphthalene sulfonate surfactant and from about 30% to about 80% of a water-soluble salt, the weight ratio of surfactant to salt being from about 1:0.3 to about 1:4.

DETAILED DESCRIPTION OF THE INVENTION

According to the present invention it has been found that certain anionic organic surfactants, namely certain naphthalene sulfonates, can be formulated in detergent cakes with relatively high levels of filler salts, and still remain sufficiently soluble to adequately perform the required surfactant functions in said compositions.

The solid cake compositions herein comprise from about 20% to about 50% of a naphthalene sulfonate surfactant having the formula:

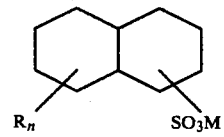

wherein each R is an alkyl group of from 1–6 (preferably 1–4) carbon atoms, n is a number of from 1 to 2 and M is a cation selected from the group consisting of alkali metals (e.g., sodium or potassium); and from about 30% to about 80% of a water soluble salt, the weight ratio of surfactant to salt being from about 1:0.3 to about 1:4 (preferably from about 1:1 to about 1:2).

All percentages and ratios herein are "by weight" unless specified otherwise.

The compositions herein will be described with particular reference to their use in conjunction with dispensers which dispense chemicals into the flush water of toilets, although it is to be understood that said compositions can be used in other applications where a solid cake surfactant composition is desired.

THE SURFACTANT

The alkyl naphthalene sulfonate surfactants of the present invention are well known compounds and are available commercially from various sources. Petrochemicals Company Inc., Fort Worth, Texas, markets a variety of naphthalene sulfonates under the name Petro, e.g. Petro AA, Petro AG Special and Petro P. Alkyl naphthalene sulfonate surfactants are also marketed by Dupont Company, Wilmington, Delaware, under the name Alkanol XC and by American Color and Chemical Company of Charlotte, N.C., under the name Amawet FN. The compounds are made by alkylating naphthalene with $C_1$ to $C_6$ alkyl halides then sulfonating the aromatic nucleus with $SO_3$ to form the corresponding sulfonic acid, and then neutralizing the acid with a strong base such as sodium hydroxide or sodium carbonate. Exemplary naphthalene sulfonate compounds within the scope of the invention are: 7-methyl-3-naphthalene sodium sulfonate, 6-butyl-2-naphthalene potassium sulfonate, 2,6-dimethyl-3-naphthalene lithium sulfonate, 1-3 di n-hexyl-7-naphthalene sodium sulfonate, 1-hexyl-3-propyl-6-naphthalene potassium sulfonate, 2,4-diethyl-5-naphthalene sodium sulfonate. The commercial products are generally a mixture of isomers and/or homologs. The naphthalene sulfonates are present in the composition herein at levels of from about 20% to about 50%.

THE SALTS

The inert salts (filler salts) used in the compositions of the present invention can be any water-soluble inorganic or organic salt or mixtures of such salts. For purposes of the present invention, "water-soluble" means having a solubility in water of at least 10 grams per hundred grams of water at 20° C. Examples of suitable salts include various alkali metal and/or alkaline earth metal sulfates, chlorides, borates, bromides, fluorides, phosphates, carbonates, bicarbonates, citrates, acetates, lactates, etc.

Specific examples of suitable salts include sodium sulfate, sodium chloride, potassium sulfate, sodium carbonate, lithium chloride, tripotassium phosphate, sodium borate, potassium bromide, potassium fluoride, sodium bicarbonate, calcium chloride, magnesium chloride, sodium citrate, sodium acetate, calcium lactate, magnesium sulfate and sodium fluoride. The preferred salts are the inorganic salts, especially the alkali metal sulfates and chlorides. Particularly preferred salts, because of their low cost, are sodium sulfate and sodium chloride. The salts are present in the compositions herein at levels of from about 30% to about 80% (preferably from about 30% to about 50%) and are used in a ratio of naphthalene sulfonate surfactant to salt of from about 1:0.3 to about 1:4, preferably from about 1:1 to about 1:2.

OPTIONAL MATERIALS

Various optional materials may be included in the compositions herein.

Dyes may be included at levels of from about 2.5% to 10%. Examples of suitable dyes are Alizarine Light Blue B (C.I. 63010), Carta Blue VP (C.I. 24401), Acid Green 2G (C.I. 42085), Astragon Green D (C.I. 42040), Supranol Cyanine 7B (C.I. 42675), Maxilon Blue 3RL (C.I. Basic Blue 80), Drimarine Blue Z-RL (C.I. Reactive Blue 18), Alizarine Light Blue H-RL (C.I. Acid Blue 182), FD&C Blue No. 1 and FD&C Green No. 3. (See the applications of Kitko, U.S. Ser. No. 972,318, filed Dec. 22, 1978 and U.S. Ser. No. 915,027, filed June 12, 1978, both incorporated by reference herein. C.I. refers to Color Index.

Partially hydrolyzed polyacrylamides and/or certain copolymers of ethylene and maleic anhydride at levels of from about 5% to about 30% are desirable components of the compositions herein when said compositions are used in conjunction with compositions which dispense hypochlorite bleach into the toilet flush water. These compounds have been found to reduce the tendency of Mn(II) ions in the water to become oxidized to MN(IV) by hypochlorite and stain the toilet bowl. Exemplary hydrolyzed polyacrylamides are those sold under the names P-35 and P-70 by American Cyanamid Company, Wayne, New Jersey. P-35 has a molecular weight of about 7000 and P-70 has a molecular weight of about 2000. Both are about 80% hydrolyzed. Exemplary ethylene/maleic anhydride copolymers are EMA-21 and EMA-31, available from The Monsanto Company, and the Gantrez resins available from General Aniline and Film Corporation. EMA-21 has a molecular weight of about 25,000 and EMA-31 has a molecular weight of about 100,000. The molecular weight range of suitable ethylene/maleic anhydride polymers for use in manganese stain control is from about 20,000 to about 100,000. The sodium-neutralized form of these copolymers are preferably used, rather than the acid form. The use of these materials in toilet bowl cleaning compositions is described in U.S. Ser. No. 28,612, Kurtz, filed Apr. 9, 1979, U.S. Ser. No. 28,613, Callicott, filed Apr. 9, 1979, and U.S. Ser. No. 29,293, Callicott, filed Apr. 9, 1979, all incorporated by reference herein.

Alkali metal bromide (e.g. sodium bromide) is a desirable component of the compositions herein when said compositions are used in conjunction with compositions which dispense hypochlorite bleach into the flush water. The bromide acts as an activator, to enhance the bleaching and sanitizing performance of the hypochlorite when the two are mixed together in the flush water. When present in the compositions herein, the alkali metal bromide will usually be at a level of 1% to 4%.

Perfumes can be incorporated into the compositions herein at levels of from about 0.5% to about 20%, preferably from about 2% to 11%. As described in Application Ser. No. 30,976 of Kacher, filed Apr. 18, 1979 (incorporated by reference herein) certain perfume materials can perform the added function of controlling the solubility of the anionic sulfonate surfactants, if this is desirable. Examples of such perfume materials are isobornyl acetate, myrtenyl acetate and frenchyl acetate.

Poly(ethylene oxide) resins having molecular weights of from about 500,000 to about 7,000,000 (preferably from about 1,000,000 to about 7,000,000) are desirable components of the compositions herein. These materials are effective in suppressing aerosolization of bowl water during the flushing of the toilet. These materials are available from Union Carbide Corporation under the name Polyox. These resins can be used in the composition herein at levels of from about 5% to about 20%. The use of such resins for aerosol suppression is further described in the Application of McCune, U.S. Ser. No. 959,405, filed Nov. 9, 1978, and the Application of Choy and Greene, U.S. Ser. No. 153,993, filed May 28, 1980.

Stabilizers for the poly(ethylene oxide) resins can be incorporated into the compositions herein to inhibit the degradation of the resin to lower molecular weight species, which may be caused by the presence of metal ions such as chromium and iron. A preferred stabilizer is thiourea, at a level of from about 1% to 20%, based on weight of resin.

Another desirable optional ingredient which is used advantageously in combination with the poly(ethylene oxide) resins is a fluorinated polyoxyethylene ethanol surfactant. An example of this type of material is Fluorad FC-170, sold by 3M Company, Minneapolis, Minn. 55101. The amount of fluorinated polyoxyethylene ethanol surfactant should be from about 1% to about 15% of the amount of poly(ethylene oxide) resin in the composition.

DISPENSING MEANS

Dispensing means which can be used to dispense compositions of the present invention into the toilet flush water are exemplified by those described in U.S. Pat. Nos. 3,831,205, 3,341,074, 3,504,384, 2,688,754, 4,036,407, 4,171,546, 4,208,747 and 4,186,856, above noted. A particularly advantageous dispensing means for use with the compositions herein when said compositions contain poly(ethylene oxide) resin, is described in the application of Choy, entitled "PASSIVE DOSING DISPENSER EXHIBITING IMPROVED RESISTANCE TO CLOGGING", U.S. Ser. No. 153,997, filed May 28, 1980 and incorporated herein by reference.

The invention herein will be illustrated by the following examples.

EXAMPLE I

This example illustrates the superior solubility of naphthalene sulfonate surfactant, compared to other anionic surfactants, in a tabletted composition containing a high amount of salt relative to the level of surfactant.

Test Procedure:

(1) 2 grams of the surfactant to be tested was weighed and mixed in a jar with 8 grams of the salt to be tested.

(2) The mixture was placed in a tabletting cylinder of 1.125 inch inside diameter and compressed to a pressure of 5000 pounds per square inch with a manually operated hydraulic press (Carver Press—12 ton—Model C). The tablet which was formed had dimensions of approximately 1.125 inches in diameter × 0.4 inch thickness.

(3) The tablet was immersed in 100 ml distilled water in a 150 ml beaker at room temperature (70°–75° F.) for 1 hour. Then the tablet was removed and the resultant solution was analyzed for surfactant concentration using a cationic titration method.

Tablets utilizing paraffin sulfonate, linear alkyl benzene sulfonate and naphthalene sulfonate as the surfactants and sodium sulfate, sodium chloride, potassium sulfate, potassium chloride, sodium salicylate and sodium acetate as salts were made and tested according to the above procedure.

Results are shown in the following tables and are expressed as percent of the surfactant in the tablet which has dissolved into the water. For the tablets utilizing $Na_2SO_4$ or NaCl as the salt, the test was replicated three times. For the other salts it was replicated twice. Each replicate was done on a previously unused tablet.

TABLE 1

| Salt | $Na_2SO_4$ | | | |
|---|---|---|---|---|
| Surfactant | % Surfactant Dissolved | | | Avg. |
| Na LAS[1] | 5.5 | 13.0 | 9.2 | 9.2 |
| Na PS[2] | 24.0 | 17.5 | 19.5 | 20.3 |
| Na NS[3] | 42.0 | 50.5 | 47.0 | 46.5 |

[1]Calsoft F-90 - sodium linear alkyl benzene sulfonate. Pilot Chemical Co., Inc.
[2]Hostapur SAS 60 - 60% solution of sodium $C_{14}$ $C_{16}$ secondary paraffin sulfonate (dried to 100% active for use herein) from American Hoechst Corporation.
[3]Petro 22 - sodium methyl naphthalene sulfonate from Petrochemicals Company, Inc.

TABLE 2

| Salt | NaCl | | | |
|---|---|---|---|---|
| Surfactant | % Surfactant Dissolved | | | Avg. |
| Na LAS | 6.0 | 0.6 | 4.7 | 3.8 |
| Na PS | 1.0 | 2.0 | 1.6 | 1.5 |
| Na NS | 41.5 | 43.5 | 39.0 | 41.3 |

TABLE 3

| Salt | $K_2SO_4$ | | |
|---|---|---|---|
| Surfactant | % Surfactant Dissolved | | Avg. |
| Na LAS | 22.0 | 25.0 | 23.5 |
| Na PS | 20.5 | 22.5 | 21.5 |
| Na NS | 65.0 | 85.0 | 75.0 |

TABLE 4

| Salt | KCl | | |
|---|---|---|---|
| Surfactant | % Surfactant Dissolved | | Avg. |
| Na LAS | 4.0 | 1.0 | 2.5 |
| Na PS | 3.0 | 2.5 | 2.8 |
| Na NS | 47.8 | 48.2 | 48.0 |

TABLE 5

| Salt | Na Salicylate | | |
|---|---|---|---|
| Surfactant | % Surfactant Dissolved | | Avg. |
| Na LAS | 13.5 | 14.0 | 13.8 |
| Na PS | 16.0 | 16.0 | 16.0 |
| Na NS | 20.0 | 19.0 | 19.5 |

TABLE 6

| Salt | Na Acetate | | |
|---|---|---|---|
| Surfactant | % Surfactant Dissolved | | Avg. |
| Na LAS | 3.5 | 3.7 | 3.6 |
| Na PS | 4.5 | 2.7 | 3.6 |
| Na NS | 13.5 | 14.1 | 13.8 |

These test results show that the solubility of the naphthalene sulfonate surfactant from a tablet with high salt content is greater than that of LAS or paraffin sulfonate.

EXAMPLE II

A composition of the present invention is prepared according to the following procedure.

(1) All dry ingredients (i.e. all ingredients except the perfume) were weighed, placed in a Waring Blender, and mixed in the blender for 5–10 minutes to form a homogeneous mixture.

(2) The perfume was then added to the mixture in the blender and mixing was continued until the total mixture was judged to be homogeneous.

(3) 60 grams of the mixture was placed into a die box having a rectangular face dimension of 5 cm by 7 cm.

(4) Using a Stokes Press, a weight of 6 tons was applied to form a tablet.

NaCl—45.0%

Petro 22[1]—22.8

EMA-21 (Na salt)[2]—16.0

Perfume[3]—9.0

Acid Green 3 Dye—4.3

NaBr—2.9

(1) Sodium methyl naphthalene sulfonate, from Petrochemicals Company, Inc.

(2) Ethylene/maleic anhydride copolymer, M.W. 25,000, from Monsanto Company.

(3) A pine fragrance perfume.

The tablet had dimensions of 5×7×1.1 cm.

This tablet is placed in an automatic dispensing device of the type described in FIG. 1 of the U.S. Pat. No. 4,208,747, Dirksing, issued June 24, 1980, and the device is suspended in the flush tank of a toilet, using a hanger device of the type described in the application of Dirksing, U.S. Ser. No. 60,088, filed July 23, 1979, said patent and application being incorporated by reference herein. The composition performs satisfactorily in the device in that proper quantities of the composition are repeatedly delivered to the flush water in response to the flushing of the toilet.

EXAMPLE III

The following composition is prepared in accordance with the procedure of Example I. Fluorad FC-170, which is a liquid, is added with the perfume.

| | |
|---|---|
| Polyox C[4] | 8.0% |
| $Na_2SO_4$ | 30.0 |
| Thiourea | 1.0 |
| Fluorad FC-170[5] | 0.25 |
| Petro BAF | 43.15 |
| Perfume[6] | 9.0 |
| Acid Green 3 | 5.7 |
| NaBr | 2.9 |
| | 100.0 |

[4]Poly(ethylene oxide) resin, M. W. 5,000,000.

[5]Fluorinated polyoxyethylene ethanol (3M Company).

[6]A pine fragrance perfume.

After stamping, this composition has dimensions of 5 cm×7 cm×1.2 cm.

This composition is placed in a dispensing device of the general type described in the Application of Choy, U.S. Ser. No. 153,997, filed May 28, 1980 and the device is suspended in the flush tank of a toilet, using a hanger device of the type described in the Application of Dirksing, U.S. Ser. No. 60,088 filed July 23, 1979. The composition performs satisfactorily in the device in that proper quantities of the compositions are repeatedly delivered to the flush water, in response to the flushing of the toilet.

What is claimed is:

1. A solid cake composition comprising from about 20% to about 50% of a naphthalene sulfonate surfactant of the formula

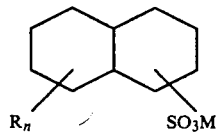

wherein each R is an alkyl group of from 1 to about 6 carbon atoms, n is a number of from 1 to 2 and M is an alkali metal, and from about 30% to about 80% of a water soluble salt selected from the group consisting of alkali metal sulfates and chlorides, the weight ratio of surfactant to salt being from about 1:0.3 to about 1:4.

2. The composition of claim 1 wherein R is an alkyl group of from 1 to about 4 carbon atoms and n is 1.

3. The composition of claim 1 or 2 wherein the ratio of surfactant to salt is from about 1:1 to about 1:2.

4. The composition of claim 3 wherein the salt is sodium sulfate.

* * * * *